US005671468A

United States Patent [19]

Yamamoto et al.

[11] Patent Number: 5,671,468

[45] Date of Patent: Sep. 23, 1997

[54] CHARGING MEMBER AND IMAGE FORMING APPARATUS HAVING CONTACT CHARGING MEMBER

[75] Inventors: Takeo Yamamoto, Yokohama; Tetsuya Kuribayashi, Tokyo; Takao Honda, Yokohama; Fumihiro Arahira, Kanagawa-ken; Hiroyuki Osada, Urawa, all of Japan

[73] Assignee: Canon Kabushiki Kaisha, Tokyo, Japan

[21] Appl. No.: 71,105

[22] Filed: Jun. 4, 1993

[30] Foreign Application Priority Data

Jun. 8, 1992 [JP] Japan ..... 4-173902

[51] Int. Cl.[6] ..... G03G 15/02

[52] U.S. Cl. ..... 399/169; 399/176

[58] Field of Search ..... 361/221, 225; 355/274, 271, 219, 222, 273; 399/169, 192, 174, 176

[56] References Cited

U.S. PATENT DOCUMENTS

| | | | |
|---|---|---|---|
| 4,326,794 | 4/1982 | Nishimura . | |
| 4,673,284 | 6/1987 | Matsumoto et al. | 355/301 |
| 4,750,019 | 6/1988 | Kamitani . | |
| 4,769,676 | 9/1988 | Mukai et al. | 355/269 |
| 4,864,367 | 9/1989 | Nakahara et al. | 355/272 |
| 4,989,037 | 1/1991 | Nagatsuna | 355/200 |
| 5,119,139 | 6/1992 | Torisawa | 355/272 |
| 5,150,165 | 9/1992 | Asai | 355/274 |
| 5,198,842 | 3/1993 | Fujino et al. | 346/159 |
| 5,253,017 | 10/1993 | Takeda | 355/219 |
| 5,272,506 | 12/1993 | Goto et al. | 355/219 |

FOREIGN PATENT DOCUMENTS

| | | |
|---|---|---|
| 0308185 | 3/1989 | European Pat. Off. . |
| 0410482 | 1/1991 | European Pat. Off. . |
| 3041123 | 5/1981 | Germany . |
| 62-51492 | 3/1987 | Japan . |
| 62-230334 | 10/1987 | Japan . |
| 63-170673 | 7/1988 | Japan . |

*Primary Examiner*—William J. Royer

*Attorney, Agent, or Firm*—Fitzpatrick, Cella, Harper & Scinto

[57] ABSTRACT

A charging device includes a movable member to be charged; a charging member contactable to the member to be charged to electrically charge the member to be charged; a discharging device, disposed upstream of a contact portion between the charging member and the member to be charged with respect to a movement direction of the member to be charged, for electrically discharging the member to be charged at a portion adjacent to the contact portion.

34 Claims, 6 Drawing Sheets

CHARGING MEMBER AND IMAGE FORMING APPARATUS HAVING CONTACT CHARGING MEMBER

FIELD OF THE INVENTION AND RELATED ART

The present invention relates to an image forming apparatus such as an electrophotographic machine, more particularly to a charging device which contacts a charging member to a surface to be charged of a member such as a photosensitive member, while charging the surface.

Heretofore, in an electrophotographic machine (a copying machine, a laser beam printer, for example) and an image forming apparatus such as an electrostatic recording machine, as for a device for electrically charging the surface to be charged such as a photosensitive member, a dielectric material or the like, functioning as the image bearing member, a corona charging device has been widely used. This corona charging device is charged using corona discharge which is air discharge. It is very effective as for the means for electrically charging the surface to be charged uniformly to a predetermined potential. On the other hand, it requires a high voltage source. Additionally, it produces a significant amount of ozone. As is different from such a corona charging device, a contact charging device is usable with a low voltage, and it has the advantage that the amount of the ozone production is small.

In a contact charging device, the charging member supplied with a voltage is contacted directly to the surface to be charged, while the surface is being charged. Because of the above described advantages, in the image forming apparatus, for example, it attracts attention as a charging device to be replaced with the corona charging device for the image bearing member or the like, and the development is carried out for practical use.

For example, Japanese Laid-Open Patent Application No. 51492/1987 and Japanese Laid-Open Patent Application 230334/1987, propose that by forming an oscillating electric field having a peak-to-peak voltage which is twice or more as high as the charge starting voltage when a DC voltage is supplied to the charging member (alternating electric field) between the charging member and the member to be charged such as the photosensitive member, and by using a charging member which is provided with a high resistance layer as the surface layer, the charge uniformity of the photosensitive member is assured. In addition, the leakage prevention of current attributable to the pin hole or the defects of the surface of the member to be charged is accomplished.

In another case, an electrically conductive member (electrically conductive potential maintaining member) such as an electrically conductive fiber brush or an electrically conductive elastic roller, is contacted to the member to be charged as the charging member, and a DC voltage is externally applied, by which the electric charge is injected directly into the surface of the member to be charged in the form of a photosensitive member, and the photosensitive member surface is charged to the predetermined potential.

FIG. 6 is a schematic view of an example of the contact type device, and the charging device shown in this Figure, is provided with a charging roller 2 and a voltage source 3.

The charging roller 2 functioning as the charging member comprises a central core metal 2*c*, a conductive layer 2*b* outside it and a resistance layer 2*c* further outside it.

The charging roller 2 is disposed in parallel with the drum-like photosensitive drum 1 functioning as the member to be charged. Simultaneously therewith, the right and left opposite end portions (opposite end portions of the longitudinal direction of the shaft) of the core metal 2*c* is supported for rotation about an unshown bearings. The charging roller 2 is press-contacted by an urging means (not shown) at predetermined urging force against the surface to be charged 1*a* of the photosensitive drum 1 surface. It is possible to forcedly drive by a motor with the provision of gear or the like rotating in a direction R2 following the rotation of the photosensitive drum 1 in the direction R1. The voltage source 3 is a bias voltage application voltage source for the charging roller 2. This voltage source 3 and the core metal 2*c* of the charging roller 2 are connected electrically with each other through a power supply sliding contact 3*a*. A predetermined bias voltage is applied by a voltage source 3 to the charging roller 2.

As for this bias, a DC bias voltage and an AC biased DC voltage, have been proposed.

When the photosensitive drum 1 is rotated in a direction indicated by arrow R1, the charging roller 2 is driven in the direction of the arrow R2. At this time, the predetermined bias voltage is applied from the voltage source 3 to the charging roller 2. By doing so, outer peripheral surface of the photosensitive drum 1, that is, the surface to be charged 1*a* is electrically charged to the predetermined polarity and to the predetermined potential.

After that, the charged photosensitive drum 1 is exposed to image light 5 in accordance with the image to be formed by this, an electrostatic latent image is formed. The electrostatic latent image is visualized with the toner in the developing device 6. The visualized toner image is transferred by a transfer charger 7 to a transfer material P.

The toner image on the transfer material P having the toner image transferred thereto is fixed by a fixing device (not shown). Thereafter, it is discharged to an outside of the apparatus. On the other hand, the photosensitive drum after the image transfer is cleaned by a cleaning blade 9*a* of a cleaning device 9 so that the remaining developer (residual toner) is removed. Subsequently, it is discharged by a pre-exposure light device 10 in preparation for the following image formation. A nip N is formed at the contact portion between the surface 1*a* to be charged of the photosensitive drum 1 and the charging roller 2. On the basis of a movement direction R1 of the surface to be charged, in the upstream side and the downstream side of the nip N, a first gap G1 and a second gap G2 are formed, respectively. When the consideration is made as to the gaps G1 and G2, that is, the distance between the surface to be charged 1*a* and the charging roller 2, the first gap gradually decreases toward the nip N, whereas the second gap increases gradually away from the nip N.

However, as in the above-described conventional example, it is known that when the surface to be charged 1*a* of the photosensitive drum 1 is contacted to the charging roller 2, while charging the surface. Not only in the nip N, but also in the first and second gaps G1 and G2 upstream and downstream thereof, respectively, by the movement of the electric charge, particularly at the initial stage, that is, at the time of the state in which the exposed surface 1*a* of the photosensitive drum 1 is not scraped to a significant extent with the cleaning blade 9*a* or the like, if a halftone or solid black image is formed, the electric charge moved from the charging roller 2 to the surface to be charged of the photosensitive drum 1 in the first gap in the upstream, starts separation discharge and is moved from the surface to be charged 1*a* to the charging roller 2 conversely in the second gap in the upstream. Therefore, there is a liability that a part of electric charge on the charged surface 1*a* is removed. A white stripe having a length of 2–10 mm and a width of 0.5 mm or less is produced in a direction perpendicular to the movement direction of the surface to be charge 1*a*, so that the stabilized image formation is disturbed.

SUMMARY OF THE INVENTION

It is an object of the present invention to provide a charging device and an image forming apparatus which is capable of charging the member to be charged in good order.

It is another object of the present invention to provide an image forming apparatus in which image defect in the form of a stripe is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the following, an embodiment of the present invention will be described in conjunction with the accompanying drawings.

Figure 1:
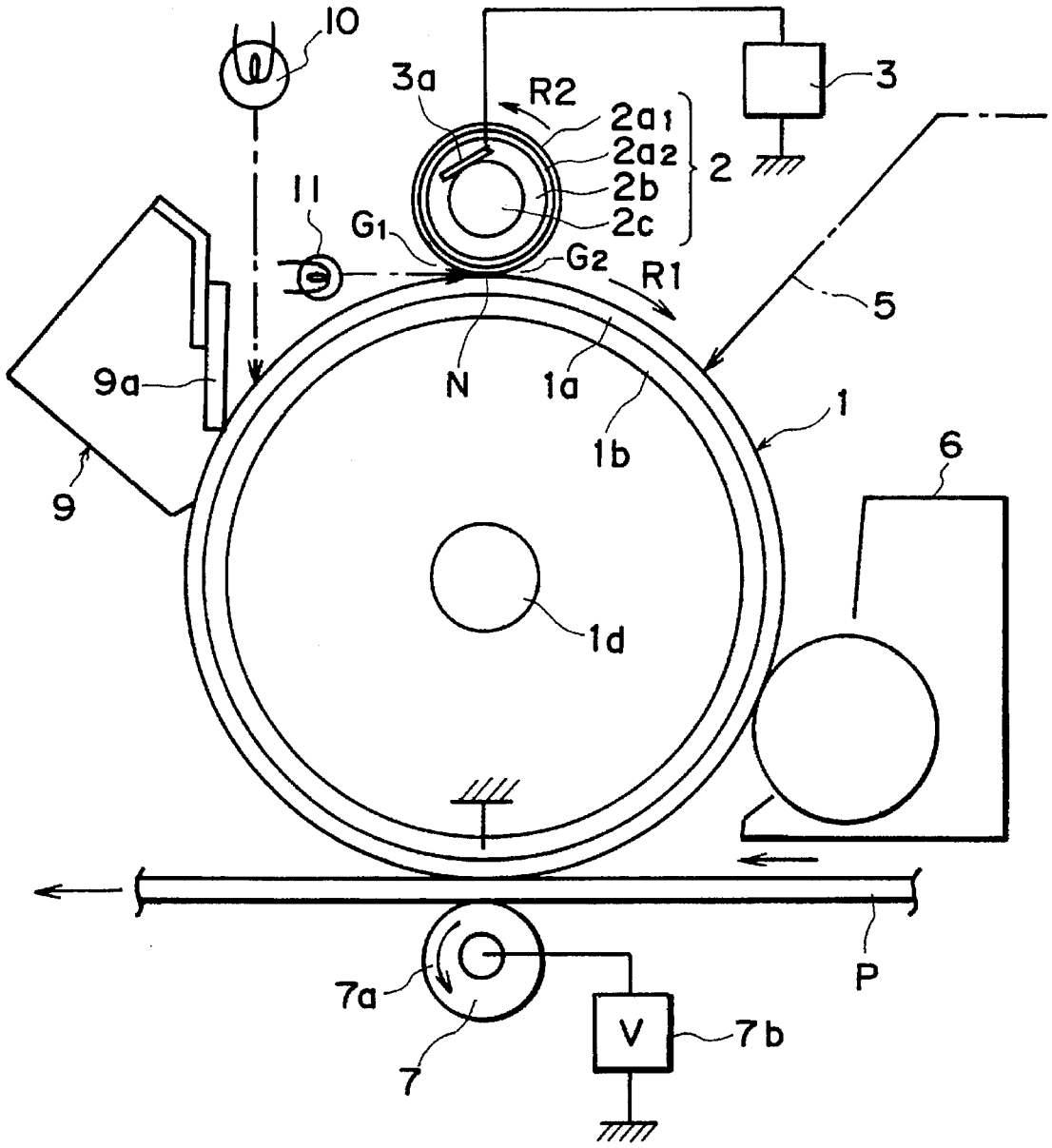
FIG. 1 is a schematic view illustrating the structure of an image forming apparatus according to the present invention.

FIG. 1 is a sectional view around an image forming station of an image forming apparatus according to an embodiment of the present invention.

In the image forming station, a cylindrical photosensitive drum 1 (member to be charged) is rotatably supported in the main assembly (not shown) of the apparatus. The photosensitive drum 1 is a drum type electrophotographic photosensitive member having an electrically conductive base layer 1*b* made of aluminum or the like, a laminated polymeric material formed thereon, that is, a photoconductive layer (surface to be charged) 1*a*. The OPC photoconductor in this embodiment is negatively chargeable. The entirety of the photosensitive drum 1 is rotated about a shaft 1*d* in a direction of an arrow R1 at a predetermined peripheral speed.

The charging member 2 is disposed above the photosensitive drum 1. The charging member 2 is contacted to the surface to be charged 1*a* of the photosensitive drum 1 to uniformly charging (primary charging) to a predetermined polarity and to the predetermined potential. In this embodiment, it is of a roller type (charging roller).

The charging roller 2 is provided with a core metal 2*c*, a conductive layer 2*b* thereon and a resistance layer 2*a*2 thereon. The longitudinal opposite end portions of the core metal 2*c* (in the direction perpendicular to the sheet of the drawing of FIG. 1) of the charging roller 2, are rotatably supported by unshown bearing members, and it is in parallel with the photosensitive drum 1. It is urged to the surface to be charged 1*a* of the photosensitive drum 1 by urging means (unshown) at a predetermined urging force. With the rotation of the photosensitive drum I in a direction R1, it is driven in a direction R2. To a core metal 2*c* of the charging roller 2, a power supply contact 3*a* is contacted. The bias voltage is applied from the voltage source through this contact 3*a*. By this, the surface to be charged 1*a* of the photosensitive drum 1 is charged to a predetermined polarity and potential. The charging roller 2 may be driven by the photosensitive drum 1. It may be positively rotated in the same direction as or in the opposite direction from the surface to be charged 1*a* of the photosensitive drum.

Furthermore, it may be fixed without rotation. The photosensitive drum which has been subjected to the charging process for uniform charging by the charging roller 2, is exposed to image information through exposure means 5 (laser beam scanning exposure, original image slit exposure or the like, and the latter is used in this embodiment). Then, an electrostatic latent image is formed on the surface 1*a* to be charged in accordance with the intended image formation. The electrostatic latent image is sequentially developed with the positively charged toner by a developing device 6 into a visualized image, sequentially.

Subsequently, the first toner image is transferred onto the transfer material P by a transfer device 7. The transfer device 7 is provided with a rotatable transfer roller 7*a* and a voltage source 7*b*. It is effective to charge the backside of the transfer material P to the polarity opposite from the toner by the roller 7*a*. By this, the toner image on the photosensitive drum 1 is sequentially transferred onto the upper surface of the transfer material P. Here, the transfer material P is conveyed from an unshown feeding device to the transfer station between the photosensitive drum 1 and the transfer device 7 at the proper timing in synchronism with the rotation of the photosensitive drum 1.

The transfer material having received the toner image P transferred thereto, is separated from the photosensitive drum 1, and it is conveyed to an unshown fixing device, and the toner image is fixed. Thereafter, it is discharged to an outside of the main assembly of the apparatus, or it is refed to the transfer station if it should receive an image on the backside, for example.

The photosensitive drum 1 after the image transfer, is cleaned by a cleaning blade 9*a* of the cleaning device 9, so that deposited contamination such as residual toner or the like is removed. Then, the residual charge is removed by the pre-exposure device 10.

Between the cleaning device 9 and the downstream charging roller 2, a charging device 11 of the present invention is disposed. The pre-exposure device 10 removes the residual charge from the surface to be charged 1*a* of the photosensitive drum 1 substantially to 0 V. The discharging device 11 is effective to provide the proper charging of the surface to be charged 1*a* by the charging roller 2. Before describing the charging device 11, the description will be made as to the charging roller 2. As shown in FIG. 1, the charging roller 2 of this embodiment comprises a core metal 2*c*, an electrically conductive rubber layer 2*b* comprising EPDM rubber (terpolymer of ethylene propylene diene) or the like and having a volume resistivity of $10^4$–$10^5$, and an intermediate resistance layer 2*a*2 of hydrin rubber or the like having a volume resistivity of $10^7$–$10^9$ ohm.cm, and a blocking layer 2*a*1 of Toresin (available from Teikoku Kagaku Kabushiki Kaisha, trade mark) or another nylon material having a volume resistivity $10^7$–$10^{10}$ ohm.cm and having a hardness of 50–70 degrees (Asker C). The charging roller 2 is contacted to the photosensitive drum 1 at a total pressure of 1600 g so as to be rotated thereby.

Here, when the charging roller 2 is contacted to the surface to be charged 1*a* of the photosensitive drum 1, first and second small gap G1 and G2 are formed at the upstream and downstream side of the nip between them. The upstream gap G1 gradually decreases toward the nip N and toward the downstream, and the downstream gap G2 increases away from the nip N and toward the downstream. The nip extends through substantially the entire length of the charging roller (axial direction). Therefore, the first and second gaps G1 and G2 extend throughout the length of the charging roller 2.

Figure 6:
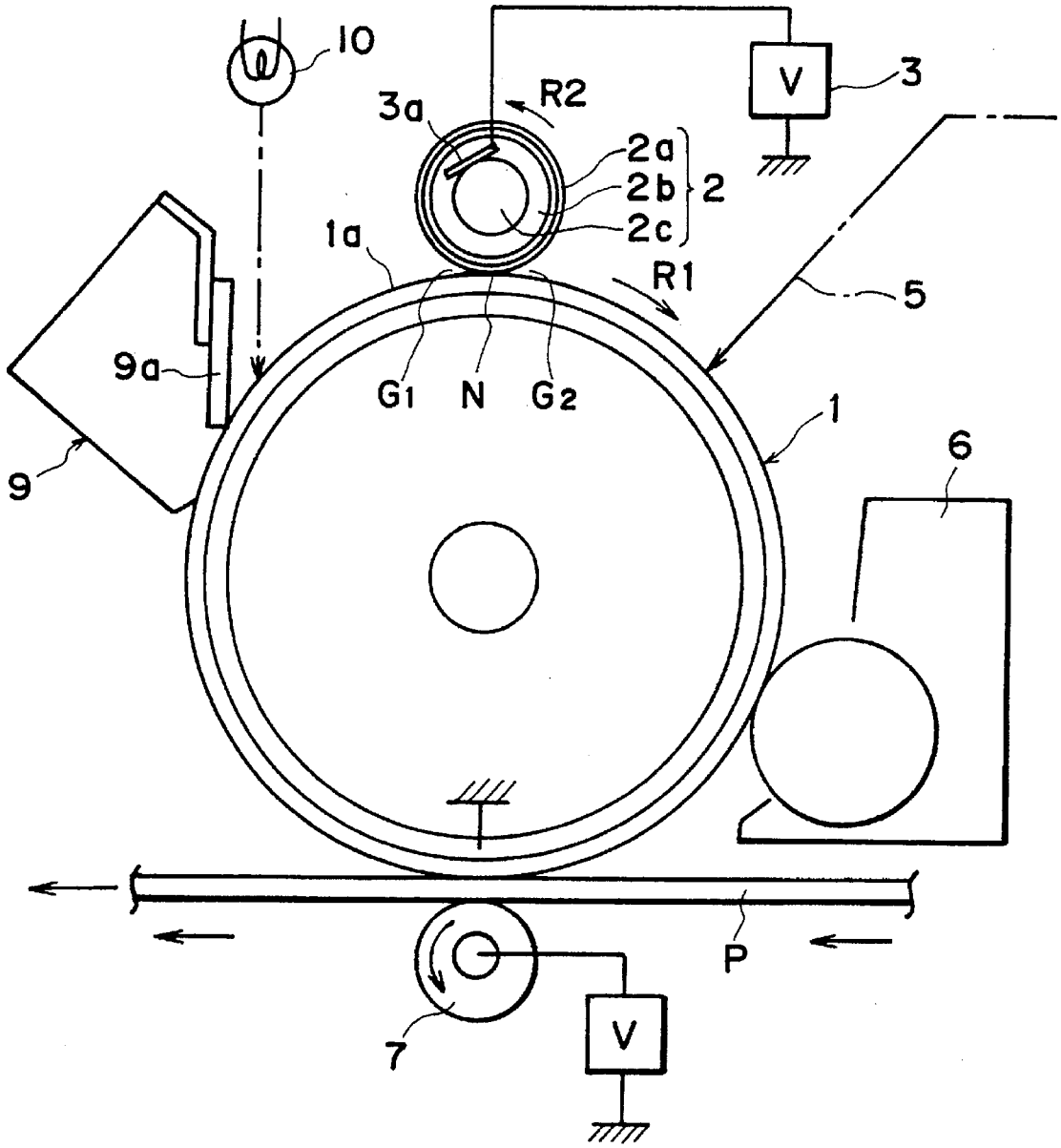
FIG. 6 is a sectional view of a conventional image forming apparatus.

The discharging device 11 comprises a light projection device comprising a fuse lamp. An illumination per unit time of the fuse lamp 11 is 5.0 Lux. It irradiates light to a portion forming the first gap G1 along the entire length in synchronism with application of the bias voltage from the voltage source 3 or for a longer period than the bias voltage application period. By the on and off of the fuse lamp 11, the surface 1*a* to be charged is electrically discharged in the portion of the first gap. If the discharging operation is not carried out, that is, when the image forming operation is carried out in the conventional manner shown in FIG. 6, a horizontal white stripe is produced from the first sheet to approx. 2000 sheet image forming operations upon forming half-tone and solid black image formations, because the charge movement between the charging roller 2 and the member to be charged 1*a* occurs in the first gap G1, nip N and the second gap G2.

Figure 5:
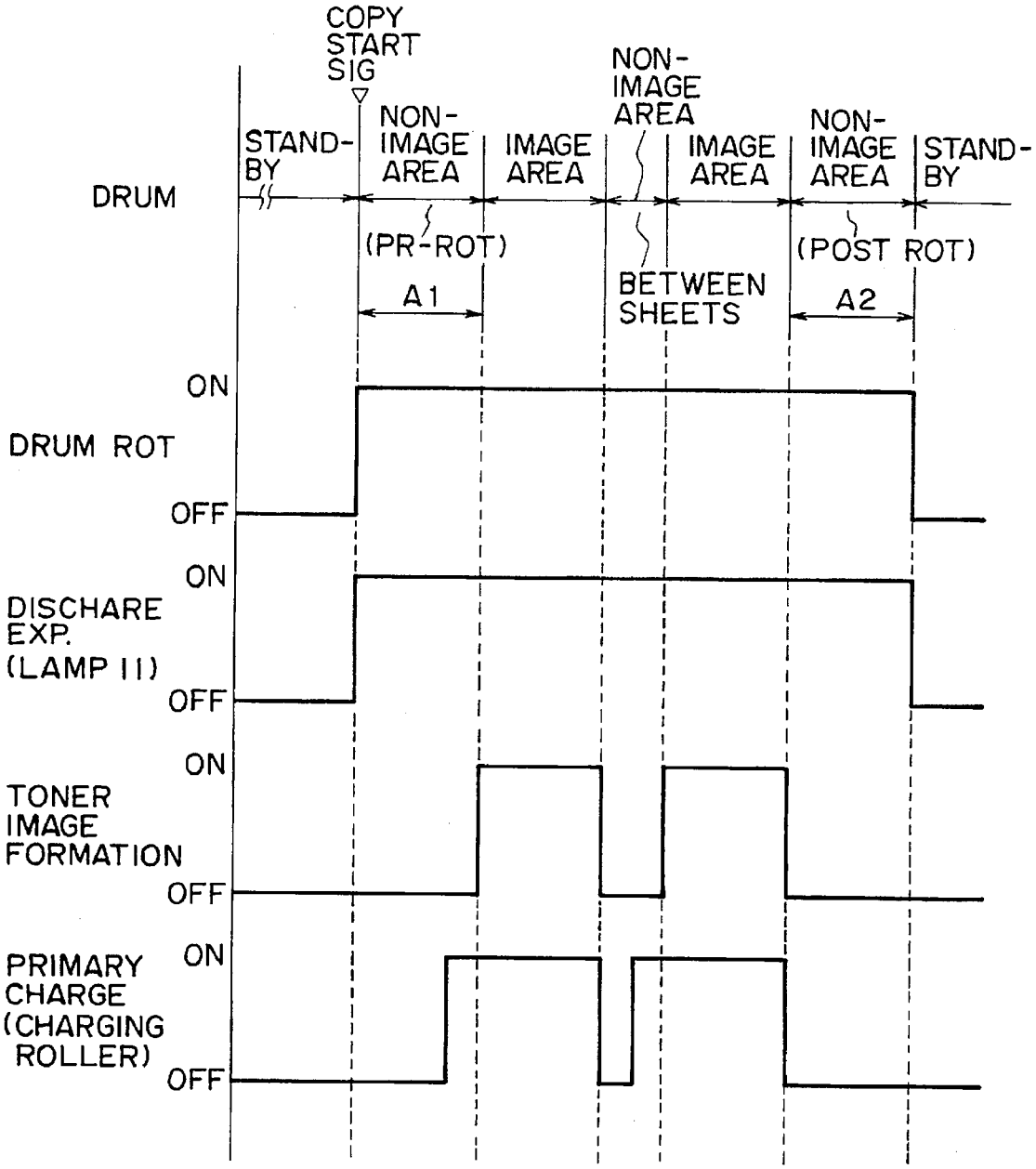
FIG. 5 shows an operation sequence of an image forming apparatus.

Referring to FIG. 5, the description will be made as to the operation sequence of the image forming apparatus of FIG. 1 when the discharge is carried out. In response to a print start signal, the photosensitive drum which has been in the stand-by state is rotated, and a pre-rotation operation is carried out. Simultaneously with the start of the photosensitive drum 1, the fuse lamp (discharging device) 11 is actuated. In a period A1, the surface to be charged 1*a* of the photosensitive drum 1 is electrically discharged through more than one full-turn.

2. Subsequently, a DC bias voltage functioning as a primary charging bias to the charging roller 2 is actuated.

3. Then, the first image formation is carried out through a slid for an original.

4. After completion of the last sheet image formation, the photosensitive drum 1 is post-rotated. During the post-rotation period A2, the discharge exposure 15 is carried out by the fuse lamp 11 through not less than one full-turn of the photosensitive drum 1, and the rotation and the discharge exposure is stopped. The apparatus returns to the stand-by state until the next print starting signal is produced.

As shown in the above-described operational sequence, the fuse lamp 11 illuminates the surface to be charged 1*a* in the first gap G1, by which the electric charge of this portion by the charging roller 2 is removed, and the charging is effected in the nip and the second gap G2. By doing so, the separation discharge which occurs by the surface to be charged 1*a* moving through the nip N and the second gap G2, and the white stripe having resulted at the time of halftone or solid black image formation can be avoided.

The time period in which the exposure by the lamp 11 is carried out may be the period in which the voltage is applied to the charging roller at the minimum.

Furthermore, the region of the drum 1 exposed to the lamp 11 light may be at least the region in which the toner image formation is possible for the next image formation. The region capable of toner image formation is a region in which a toner image can be formed on the drum 1 for any image information.

Since the surface of the phosensitive drum has been electrically discharged by the lamp 10 when the surface is going to reach the nip N, the lamp 11 functions to prevent the surface from being electrically charged by the charging roller 2.

Embodiment 2

Figure 2:
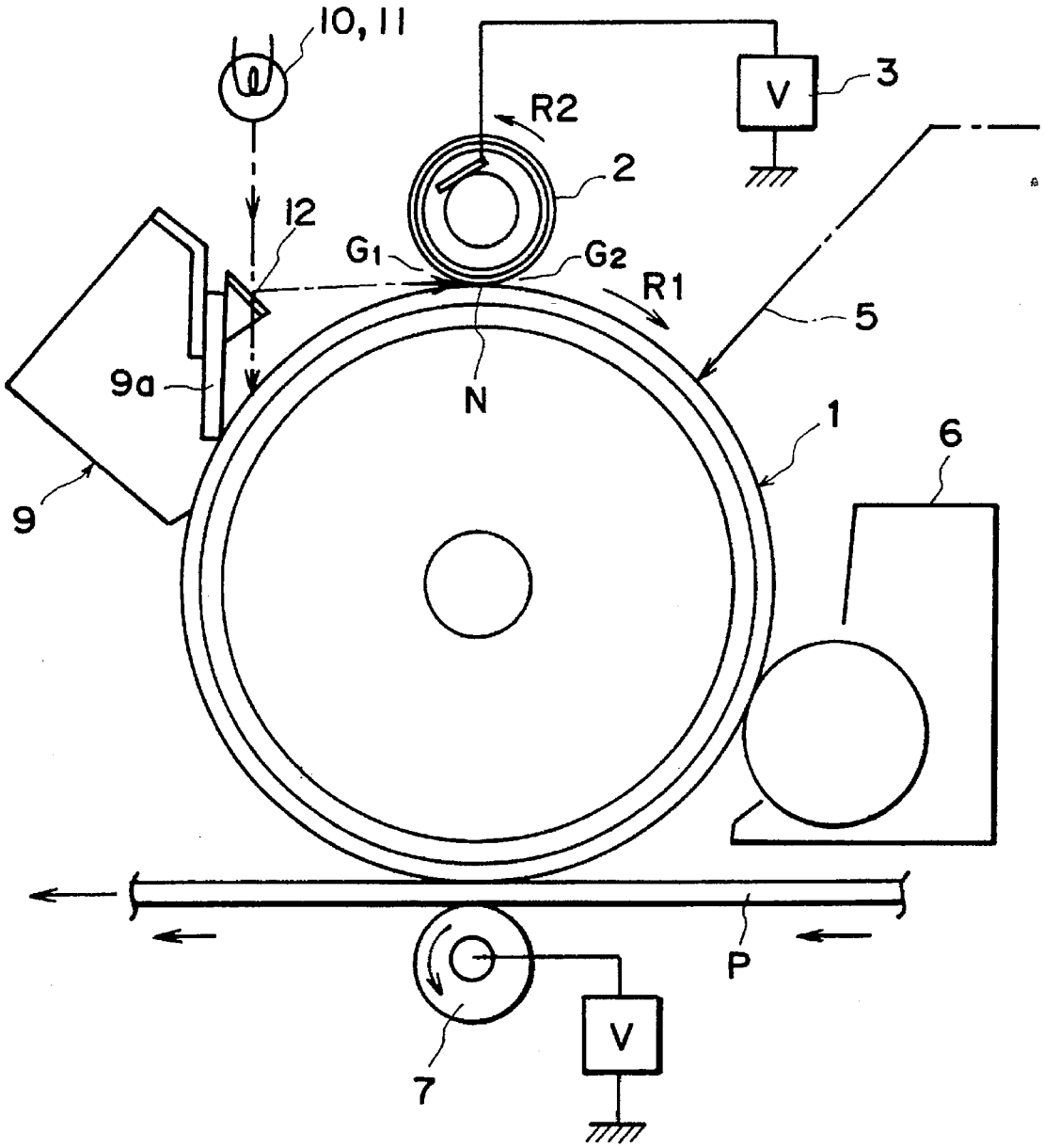
FIG. 2 is a sectional view illustrating a discharging device according to another embodiment of the present invention.

Referring to FIG. 2, another embodiment of the charging device 11 will be described. The charging device 11 may also function as a pre-exposure device 10.

For example, a half mirror 12 is attached to a cleaning blade of the cleaning device 9, and the illumination light from the discharging device 11 (pre-exposure device 10) is divided into the light for discharging the surface to be charged 1*a* immediately after the cleaning station and the light for discharging the surface to be charged 1*a* at the first gap G1 for the charging. By doing so, there is no need of using special exposure device for the discharge of the first gap G1, and the entire structure is simplified, and in addition, the operational sequence can be simplified. In place of the half mirror 12, a total reflection mirror or a member finished to a mirror surface by evaporation or metal plating is usable. It is disposed for retraction so that the optical path of the illuminating light is switched between for the cleaning blade 9*a* and for the first gap G1.

It is preferable that a tangent line of the nip N is substantially in accord with the beam from the lamp, as shown in FIGS. 1 and 2, since then, the light reaches deep into the gap G1.

Embodiment 3

Figure 3:
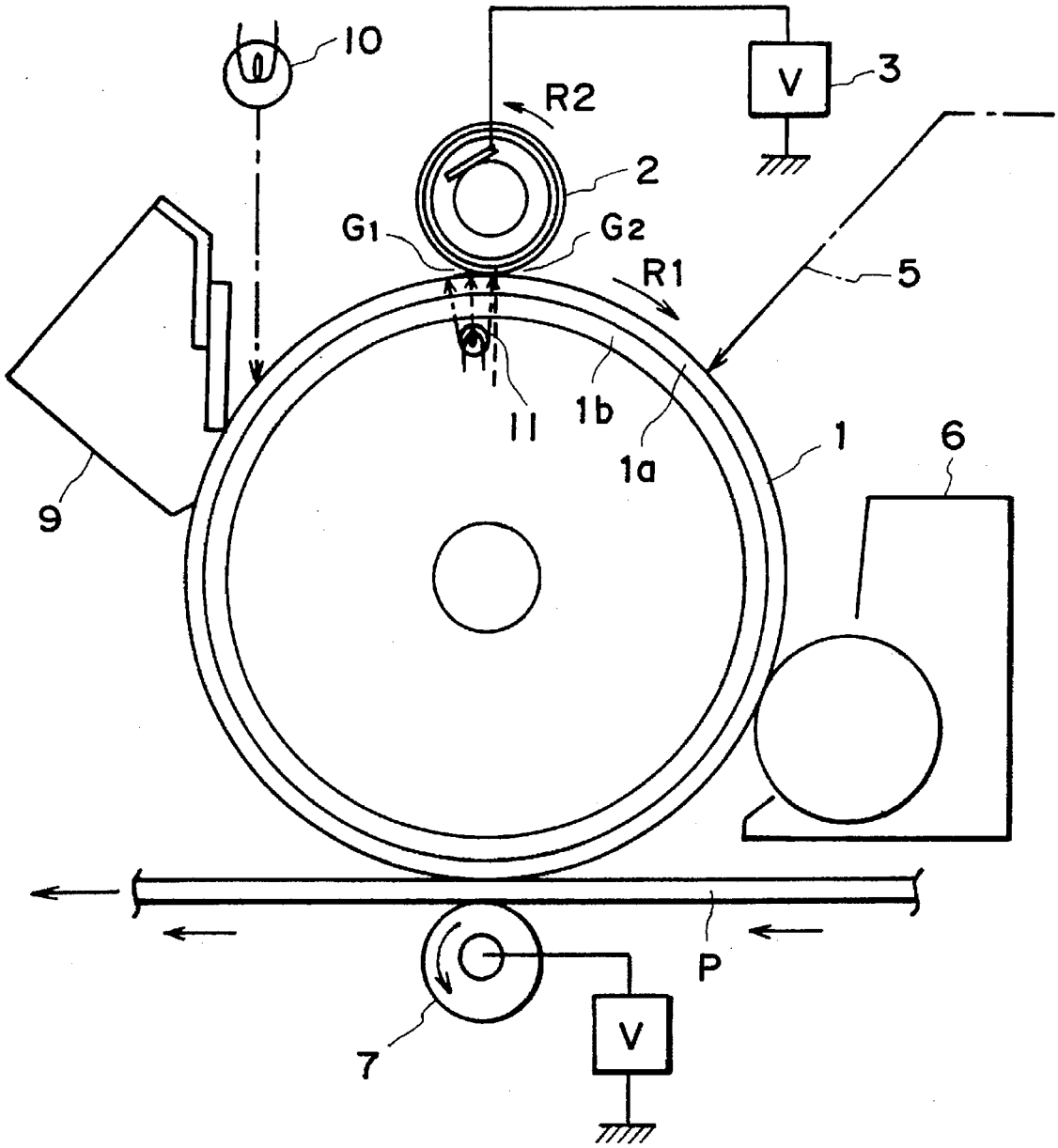
FIG. 3 is a sectional view of a discharging device according to another embodiment of the present invention.

Referring to FIG. 3, a further embodiment will be described. As shown in this Figure, an outer circumference of the photosensitive drum 1, that is, the photoconductive layer 1*a* and the conductive base layer 1*b*, are formed with known transparent photosensitive material, and the discharging is effected with a discharging device 11 disposed inside the transparent photosensitive member with the light amount of 10 Lux.sec by the discharging device 11. The discharging device 11 thus electrically discharge the photosensitive member in the gap G1 along the entire length thereof in the width of 3 mm. The discharging device 11 may include an LED lamp. In embodiments 1 and 2, there is a liability that the light source or the mirror surface may be contaminated with the result that the amount of the light may be reduce by the scattered toner during use thereof or the like. However, in this embodiment, the light source is disposed inside the photosensitive drum, the discharge can be carried out, so that the horizontal white stripe can be avoided without the contamination and with a constant light quantity at all times, and with stability. The description will be made as to another charging member. In the foregoing embodiments, the charging roller comprises a core metal and three layers thereon. In this embodiment, has two layers on the core metal, as shown in FIG. 4.

Figure 4:
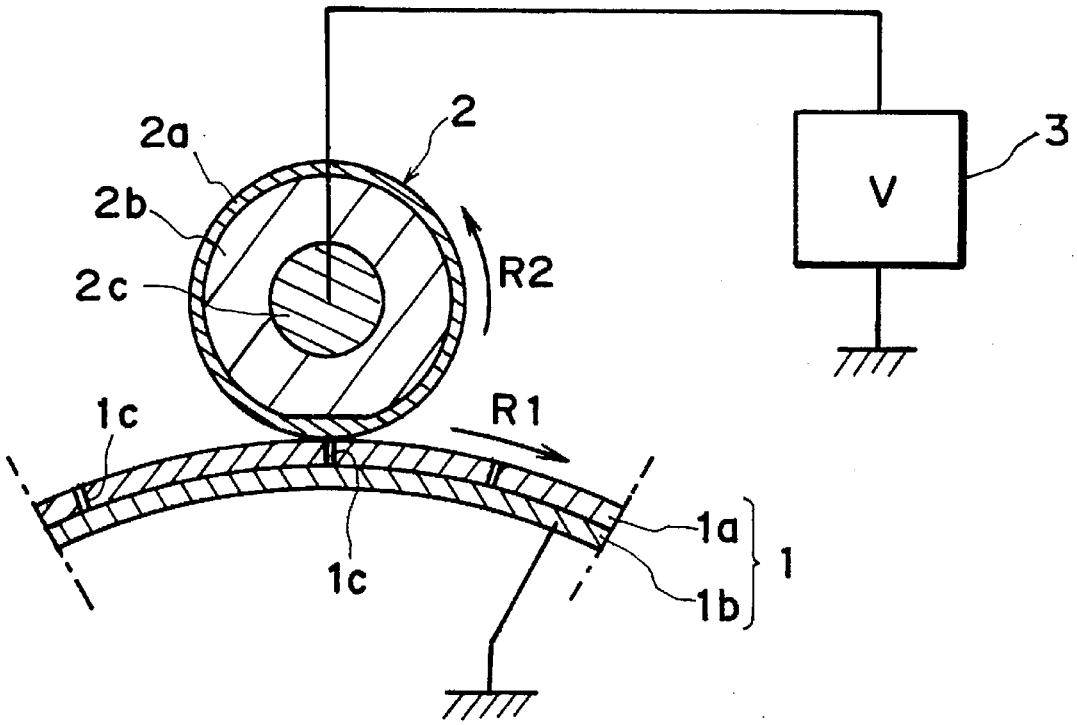
FIG. 4 is a sectional view illustrating a charging roller according to a further embodiment of the present invention.

The charging roller 2 shown in FIG. 4 comprises a core metal 2*c*, an electrically conductive layer 2*b* thereon and a high resistance layer 2*a* mainly comprising resin material thereon. By doing so, even if there are pin holes 1*c* and 1*c* or defects in the photoconductive layer 1*a* of the photosensitive drum 1, it can be avoided that the current leaks through these pin holes or the like.

The discharging device 11 having been described in Embodiments 1–4, both can be equally used when the bias voltage to be applied to the charging roller 2 by the voltage source 3 comprises only DC component, and when it is a DC biased AC.

Furthermore, the discharging device 11 is not limited to the light projection device such as the fuse lamp, but may be of another means, as long as the surface to be charged forming the first gap G1 can be effectively discharged. For example, a discharging brush is disposed in contact with the entire length of the surface 1*a* to be discharged. By this, substantially the same effects as in the light projection device can be provided. However, it is desirable to electrically isolate the ends of the discharging brush from the charging roller. It is desirable that when the charging roller is not urged to the photosensitive drum at all, it has a crowned roller, wherein the outside diameter gradually decreases from the longitudinal center of the roller toward the respective ends thereof, since then when the ends of the core metal of the charging roller are urged to press it to the photosensitive drum, the nip between the roller and the drum becomes straight in the longitudinal direction substantially with the constant width. If the nip is straight in the longitudinal direction in this way, the light by the discharging device (exposure lamp) becomes straight in the longitudinal direction, and therefore, it is easy to project the light to the drum at the upstream side of the nip.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member, said image bearing member including a photosensitive layer;

a charging member contactable to said image bearing member to electrically charge said image bearing member, wherein said charging member effects electric discharge at a downstream-side gap which is formed between said image bearing member and said charging member at a downstream-side of a nip formed therebetween; and exposure means for exposing said image bearing member, said exposure means exposing to light an area of said image bearing member corresponding to an upstream-side gap formed between said image bearing member and said charging member at an upstream-side of said nip, wherein the upstream-side gap reduces gradually from an upstream position of said nip with respect to a movement direction of said image bearing member toward said nip.

2. An apparatus according to claim 1, wherein said area extends along a length of said charging member.

3. An apparatus according to claim 1, wherein said charging member is supplied with a voltage during operation of said exposure means.

4. An apparatus according to claim 1, further comprising developing means for developing said image bearing member with toner, using the charging of said charging member, and said exposure means exposes to the light at least a range in which a toner image is going to be formed by the developing means.

5. An apparatus according to claim 1, wherein if said charging member is free of mechanical load, said charging member having a diameter which increases away from an urging portion where it is urged to said image bearing member.

6. An apparatus according to claim 1, wherein if said charging member is free of mechanical load, said charging member having an outer diameter which increases away from a longitudinal end thereof.

7. An apparatus according to claim 1, wherein said exposure means projects light to an adjacent area in a direction substantially along a tangent line at said nip.

8. An apparatus according to claim 1, wherein said charging member comprises an electrically conductive layer and a resistance layer thereon.

9. An apparatus according to claim 1, wherein said charging member comprises an electrically conductive layer, a resistance layer thereon, and a non-rubber surface layer.

10. An apparatus according to claim 1, wherein said charging member is a rotatable member, and said exposure means is effective to suppress electric discharge occurring between said charging member and said image bearing member in said upstream-side gap.

11. An apparatus according to claim 1, wherein said charging member is a rotatable member, and said exposure means is effective to suppress electric discharge occurring between said charging member and said image bearing member at said upstream-side gap without suppressing electric discharge between said charging member and said image bearing member at said increasing gap area.

12. An apparatus according to any one of claims 1–3, wherein a DC voltage without an AC component can be applied between said charging member and said image bearing member.

13. An apparatus according to any one of claims 1 and 2–9, wherein said charging member is a rotatable member.

14. An apparatus according to claim 1, further comprising transfer means for transferring an image from said image bearing member to a transfer material, wherein said exposure means exposes said image bearing member at a position downstream of said transfer means and upstream of said upstream-side gap with respect to a movement direction of said image bearing member.

15. An apparatus according to claims 1 or 14, further comprising light reflecting means for reflecting light from said exposure means to the area of said image bearing member corresponding to the upstream-side gap.

16. An apparatus according to claim 1, wherein said exposure means projects light to said area substantially in the same direction as a tangential direction of said image bearing member.

17. A charging device for charging a movable member to be charged, comprising:

a movable member to be charged;

a charging member contactable to said member to be charged to electrically charge the member to be charged, said charging member being a rotatable member, wherein said charging member effects electric discharge at a downstream-side gap which is formed between said member to be charged and said charging member at a downstream-side of a nip formed therebetween; and discharge suppressing means for suppressing electric discharge between the member to be charged and said charging member, at an upstream-side gap formed on an upstream-side of said nip, wherein the upstream-side gap reduces gradually from an upstream position of said nip with respect to a movement direction of the member to be charged toward said nip.

18. An image forming apparatus comprising:

a movable image bearing member;

a charging member contactable to said image bearing member to electrically charge said image bearing member, said charging member being a rotatable member, wherein said charging member effects electric discharge at a downstream-side gap which is formed between said image bearing member and said charging member at a downstream-side of a nip formed therebetween; and discharge suppressing means for suppressing electric discharge between said image bearing member and said charging member at an upstream-side gap formed on an upstream-side of said nip, wherein the upstream-side gap reduces gradually from an upstream position of said nip with respect to a movement direction of said image bearing member toward said nip.

19. An apparatus according to claim 18, wherein said discharge suppressing means suppresses the discharge over substantially the entire length of the nip at the upstream-side gap.

20. An apparatus according to claim 18, further comprising developing means for developing said image bearing member with toner, using the charging of said charging member, and said suppressing means suppresses the discharge at least a range in which a toner image is going to be formed by the developing means.

21. An apparatus according to claim 18, wherein if said charging member is free of mechanical load, the charging member having a diameter which increases away from an urging portion where it is urged to said image bearing member.

22. An apparatus according to claim 21, wherein if said charging member is free of mechanical load, an outer diameter of said charging member increases away from a longitudinal end thereof.

23. An apparatus according to claim 18, wherein said charging member comprises an electrically conductive layer and a resistance layer thereon.

24. An apparatus according to claim 18, wherein said charging member comprises an electrically conductive layer, a resistance layer thereon and a non-rubber surface layer.

25. An apparatus according to claim 18, wherein said discharge suppressing means does not suppress the discharge between said charging member and said image bearing member at said downstream-gap.

26. An apparatus according to any one of claims 18 and 19–25, wherein a DC voltage without an AC component can be applied between said charging member and said image bearing member.

27. An apparatus according to claims 1 or 18, further comprising a cleaner for removing residual matter from said image bearing member, wherein a surface of said image bearing member cleaned by the cleaner is contacted by said charging member.

28. An image forming apparatus comprising:

a movable image bearing member, said image bearing member including a photosensitive layer;

a charging member contactable to said image bearing member to electrically charge said image bearing member, wherein said charging member effects electric discharge at a downstream-side gap which is formed between said image bearing member and said charging member at a downstream-side of a nip formed therebetween; and illuminating means for illuminating a boundary between a first portion where said charging member is in contact with said image bearing member, and a second portion of said image bearing member, adjacent to the first portion and upstream of the first portion with respect to a movement direction of said image bearing member, where said charging member is out of contact with said image bearing member.

29. An apparatus according to claim 28, further comprising developing means for developing said image bearing member with toner, using the charging of said charging member, and said illuminating means exposes to the light at least a range in which a toner is going to be formed by the developing means.

30. An apparatus according to claim 28, further comprising a cleaner for removing residual matter from said image bearing member, wherein a surface of said image bearing member cleaned by the cleaner is contacted by said charging member.

31. An apparatus according to claim 28, further comprising transfer means for transferring an image from said image bearing member to a transfer material, wherein said illuminating means illuminates said image bearing member at a position downstream of said transfer means and upstream of said upstream-side gap with respect to a movement direction of said image bearing member.

32. An apparatus according to claim 28 or 31, further comprising light reflecting means for reflecting light from said illuminating means to said boundary.

33. An apparatus according to claims 1, 18 or 28, further comprising image exposure means for exposing said image bearing member charged by said charging member to image light, wherein a potential of said image bearing member is substantially constant after it is charged by said charging member before it is exposed by said image exposure means.

34. An apparatus according to claim 28, wherein said illuminating means projects light to said boundary substantially in the same direction as a tangential direction of said image bearing member at said first portion.

* * * * *

UNITED STATES PATENT AND TRADEMARK OFFICE

CERTIFICATE OF CORRECTION

PATENT NO. : 5,671,468

DATED : September 23, 1997

INVENTORS : Takeo Yamamoto, et al.

It is certified that error appears in the above-identified patent and that said Letters Patent is hereby corrected as shown below:

COLUMN 4

Line 6, "I" should read --1--.

COLUMN 8

Line 24, "claims 1-3" should read --claims 1-11--.

COLUMN 9

Line 21, "suppressing" should read --discharge suppressing--;
Line 29, "claim 21" should read --claim 18--;
Line 43, "claims 18 and" should read --claims 18-25,--; and
Line 44, "19-25," should be deleted.

Signed and Sealed this

Fourteenth Day of April, 1998

Bruce Lehman

*Attest:*

BRUCE LEHMAN

*Attesting Officer*

*Commissioner of Patents and Trademarks*